United States Patent [19]

Karrenberg

[11] Patent Number: 4,949,320

[45] Date of Patent: Aug. 14, 1990

[54] ACOUSTIC SIGNAL APPARATUS

[76] Inventor: Georg Karrenberg, Hauptstr. 26, D-8037 Olching, Fed. Rep. of Germany

[21] Appl. No.: 395,294

[22] Filed: Aug. 17, 1989

Related U.S. Application Data

[63] Continuation of Ser. No. 163,756, Jan. 19, 1988, abandoned.

[30] Foreign Application Priority Data

Jun. 19, 1985 [DE] Fed. Rep. of Germany ..... 3521911

[51] Int. Cl.[5] ..... G04F 8/00; G04F 7/06

[52] U.S. Cl. ..... 368/109; 368/250

[58] Field of Search ..... 368/107–113, 368/250, 251, 261

[56] References Cited

U.S. PATENT DOCUMENTS

| | | | |
|---|---|---|---|
| 4,104,865 | 8/1978 | Sasaki | 368/261 |
| 4,147,021 | 4/1979 | Kondo | 368/251 |
| 4,218,871 | 8/1980 | Moritani et al. | 368/109 |
| 4,473,884 | 9/1984 | Behl | 368/109 |
| 4,491,423 | 1/1985 | Cohen | 368/107 |
| 4,493,043 | 1/1985 | Forbath | 368/251 X |
| 4,632,570 | 12/1986 | Kelsey | 368/107 |
| 4,659,233 | 4/1987 | Nakamura et al. | 368/261 |
| 4,711,585 | 12/1987 | Fresquez et al. | 368/109 |
| 4,768,176 | 8/1988 | Kehr et al. | 368/109 |

FOREIGN PATENT DOCUMENTS

| | | |
|---|---|---|
| 355895 | 3/1980 | Austria . |
| 2829320 | 7/1978 | Fed. Rep. of Germany . |
| 2065338 | 11/1979 | United Kingdom . |

OTHER PUBLICATIONS

Elektror, vol. 6, No. 7/8, Jul./Aug. 1980, Canterbury (Gb), B. Köhler: "Current Saving Home Trainer", pp. 7–24.

Patents Abstracts of Japan, vol. 5, No. 175 (P-88)(847 11.11.1981, & JP, A, 56103397 (Dani Seikosha K.K.) 18.08.1981.

*Primary Examiner*—Vit W. Miska

*Attorney, Agent, or Firm*—Price, Gess & Ubell

[57] ABSTRACT

Acoustic signal apparatus, especially used as time tapper for sportive interval trainings, having a signal giving device (3) producing acoustic signals, said signal giving device (3) being controlled by a master clock device (1) to produce a plurality of acoustic pulses mutually shifted by predetermined clock intervals. Mutually different acoustic pulses are produceable by the signal giving device (3), and the signal giving device (3) is controlled by the master clock device (1) in such a way that the mutually different acoustic pulses are mutually time shifted alternatingly in cyclical repetitions for predetermined clock intervals, said clock intervals being adjustable independently of each other by the adjusting device (13, 14) of the master clock device (1).

3 Claims, 3 Drawing Sheets

ACOUSTIC SIGNAL APPARATUS

This is a continuation of application Ser. No. 163,756, filed on Jan. 19, 1988, now abandoned.

This invention pertains to an acoustic signal apparatus, especially used as time tapper for sportive interval trainings, having a signal giving device producing acoustic signals, said signal giving device being controlled by a master clock device and being activatable to produce a plurality of acoustic pulses mutually shifted by predetermined clock intervals which are adjustable by an adjusting device of the master clock device.

In the U.S. Pat. No. 3,789,402 such a signal apparatus is provided for acoustically signalising mutually alternating walking intervals and running intervals when training running, and mutually alternating running periods and rest periods can be signalised for interval trainings. When a clock interval of e.g. five minutes is set for an interval training, an acoustic pulse resounds every five minutes, so that the sportsman can await the second acoustic pulse for a running period of e.g. ten minutes, where upon the third signal signalises the end of the following rest period of five minutes. Therefore, if one of these periods shall be longer than the other period which corresponds to the set clock interval, the sportsman will have to count the number of acoustic pulses during the longer period, whereby it can happen that he miscounts the numnber of pulses or simply cannot concentrate any more. For training running, the settable total running time will be divided in e.g. eigth time intervals of the same length, at the respecitve ends of which an acoustic pulse is produced, which can be different to the acoustic pulse produced by the interval master clock. However, it is impossible to establish an acoustic indication of differently long running periods and rest periods even when simultaneously switching on the interval master clock and the running clock, if the running period and the resting period following thereafter too shall, in their duration, be independent of each other.

The problem of the invention has for its basis to create an acoustic signal apparatus which is suited to be used as time tapper for sportive interval trainings also when the running and rest periods have different durations, without distracting the sportsman.

According to the invention, this problem is solved for an acoustic signal apparatus of the kind mentioned at the beginning in that mutually different acoustic pulses are produceable by the signal giving device and that the signal giving device is controlled by the master clock device in such a way that the mutually different acoustic pulses are mutually time shifted alternatingly in cyclical repetitions for predetermined clock intervals, said clock intervals being adjustable independently of each other by the adjusting device of the master clock device.

As, according to the invention, a plurality of predetermined clock intervals, which may have different duration, alternate in cyclical repitions, the signal apparatus according to the invention can e.g. be used to signalise the beginning and the end of a sportive exercise preset in time, which shall be repeated with the interposition of rests preset in time. As, according to the invention, the acoustic pulses alternating in cyclical repitions are distinguishable from each other, e.g. the beginning of the exercise can be signalised by another signal than the end of the exercise. As further to that, according to the invention, the clock intervals after the respective expiration of which an acoustic pulse is produced, can be set independently of each other, the exercising and the resting periods can be arranged individually and can be adapted to the kind of exercise and to the condition of the sportsman without making necessary the counting of number of successive acoustic pulses.

By way of the signal apparatus according to the invention, at least two different acoustic pulses of short duration, e.g. a second or less, are produceable in cyclical repetition. However, even more than two cyclically alternating acoustic pulses, which can be preset respectively, can be signaliseable. If, for example, three individually presettable clock intervals can be signalised, operation of the signal apparatus according to the invention with two cyclically alternating clock intervals can be achieved by equating to zero one clock interval, where additionally a measure can be taken to suppress the acoustic pulse indicating the beginning of the clock interval set to zero. Further to that, it is possible to provide a total time master clock device which automatically makes resound a special acoustic signal different to the other signals after the expiration of a preset total time, said signal signalising the end of the total running exercise. Finally, a presetable programmed automatic operation can be provided, by which the first and/or the other clock interval is changed during the repetition duration of the cycles from one cycle to the next or after a predetermined number of cycles, that is it is shortened or prolonged. Thereby, one can e.g. progressively shorten or lengthen the duration of the exercising periods and/or resting periods in the course of the total exercise.

The different acoustic pulses may differ in duration. It is meanwhile preferred, that the different acoustic pulses are composed of different sound frequences, e.g. have different sound spectra, so that the acoustic pulses can be distinguished from each other by their tone difference or by the kind of noise that they produce.

It is preferred that the master clock device has a switch device for selectively switching from one clock interval to the beginning of the other clock interval. Therefore, one can, on the one hand, choose the clock interval to begin with, and on the other hand, a longer clock interval may be interrupted, upon which interruption one can begin with a new cycle.

Preferably, the clock intervals last integer muliples of seconds. If, for example, the adjusting device is settable in three decades, as preferred in an embodiment, clock intervals from 1 to 999 seconds can be set.

Additional to the signal giving device, an indication device numerically depicting the time evolution of each of the clock intervals can be provided with the signal apparatus according to the invention, said indication device being controlled of the master clock device and set to zero by every switch from one clock interval to the next. Apart from that, preferably a light-signal device is provided, by which the respective clock interval under process can be indicated by different light-signals, particularly by durable light-signals mutually different in colour.

According to the invention, it is preferred that also a stop watch is built into the apparatus, said stop watch running in cycles of 10th or 100th seconds. If there is provided a numerical indicating device depicting the time evolution of each of the clock intervals, it is preferred that said indicating device can be switched to be operated as a stop watch, so that it can deliberately be operated as a stop watch also.

In the case that it is supplied with a time evolution indicating device, the acoustic signal apparatus according to the invention can be developed as mains supplied console with preferably big displays. When the acoustic signal apparatus is developed as a console, the signal giving device together with the master clock device and its adjusting device are preferably accomodated in a battery supplied little appliance, which can deliberately be detached from the console and can be taken along by the sportsman e.g. for a cross-country running exercise. With this embodiment, the time evolution indicating device is preferrably developed at the console.

However, the acoustic signal apparatus according the invention can right away be developed as a light, small apparatus, which can be carried on the human body of the sportsman, comprising a collar, so that it can be carried along as a collar hanger, or it can be provided in the form of a pocket watch or a wrist-watch with a bracelet or the like. Thereby, the acoustic signal apparatus according to the invention is particularly suited for cross-country interval running exercises.

In an embodiment, were two in cyclical repetitions alternating clock intervals, which are adjustable independently of each other, are signalised of different acoustic pulses, it is further possible, according to a further preferred embodiment of the invention, that additional acoustic signals distinguishable from the two different acoustic pulses can be produced by the signal giving device, the signal giving device additionally being controllable by the master clock device in such a way that the additional acoustic signal is produced at the respective beginnings of a residual time interval before the end of every second clock interval, said residual time intervals being separately adjustable by the adjusting device.

Therefore, the residual time interval can be the last time interval of a running period, e.g. to indicate, that a sprint has to be carried out from now on until the end of the running period. It is preferred that the additional acoustic signal is not only produced at the respective beginning of the residual time interval but rather during the whole residual time interval in a continuous or pulsating way, whereby the continuous or pulsating acoustic signal can increase or decrease in volume during the residual time interval, thereby additionally urging the sportsman to run faster during the sprinting period.

The invention will now be discribed by way of preferred embodiments, which are schematically shown in the drawing, in which.

Figure 1:
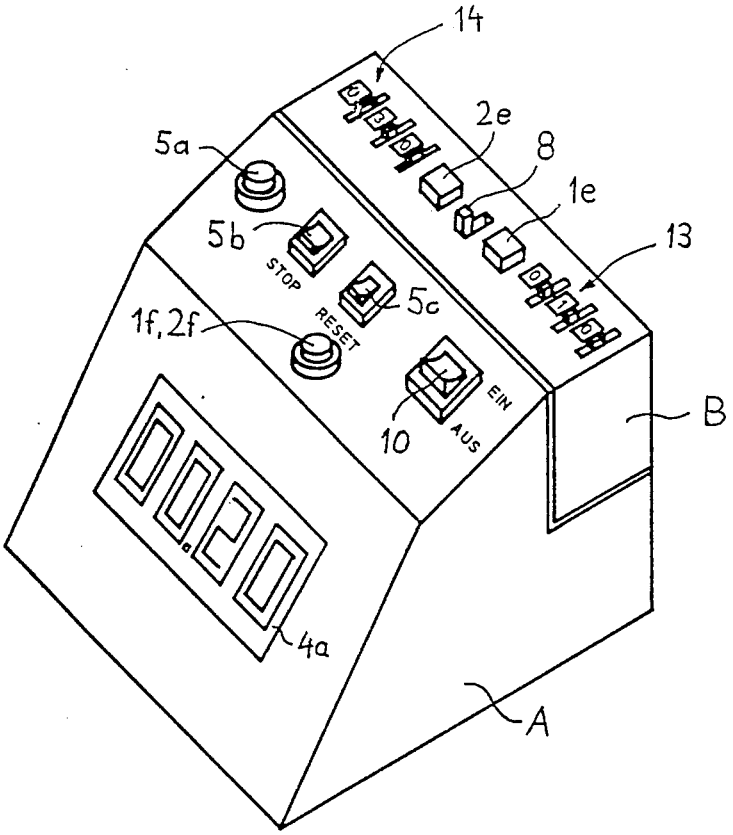
FIG. 1 is a perspective view of an acoustic signal apparatus according to the invention, developed as a console.

FIG. 1 shows an acoustic signal apparatus in form of a console for the use as time tapper for sportive interval trainings, provided with a signal giving device producing acoustic signals and a master clock device for the production of a plurality of acoustic pulses mutually shifted by predetermined clock intervals, said apparatus being developed as mains supplied apparatus. With the embodiment of the acoustic signal apparatus depicted in FIG. 1, two acoustic pulses differing in height can be produced alternatingly in cyclical repetitions. For adjusting the clock intervals, there are generaly arranged several, in case of the embodiment two adjusting devices 13, 14 outside the housing, said adjusting devices all having three digits, so that clock intervals from 1 to 999 seconds can be adjusted. Further to that, the actuating element 10 of an on/off-switch of the master clock device and of the signal giving device is arranged outside the housing. At the upper side of the housing there is also arranged a light-signal device 1*f*, 2*f* which is capable of giving two light-signals different in colour, of which each can be associated to one of the clock intervals, so that one can determine from the prevalent light-signal, which clock interval presently is running. With help of two switches 1*e*, 2*e*, the respective clock interval presently running can be set to zero and the other clock interval can be started. At the front side of the housing there is further arranged the numeric, four digit display panel 4*a* of an indicating device depicting the time evolution of each of the clock intervals.

The acoustic signal apparatus depicted in FIG. 1 can also be used as a stop watch, for which the indicating device with display panel 4*a*, depicting the time evolution of the clock intervals, can be switched to word as a stop watch. For this reason, there are arranged at the upper side of the housing a stop watch starting switch 5*a* also optically indicating if the device is switched to stop watch operation, a stopping switch 5*b* for stopping the stop watch, and a set back switch 5*c* for resetting the indicating device back to zero. In the embodiment, the stop watch is timed to a 1/100 second. During the operation of the device as stop watch, only the indicating device including display panel 4*a* of the acoustic signal apparatus is switched to stop watch operation, meanwhile the master clock device and the signal giving device of the acoustic signal apparatus can still be in operation. Therefore, the device can be used simultaneously as a time tapper for sportive interval trainings and as stop watch e.g. for taking the time of a sportsman participating in the interval training and of another sportsman who is exercising running.

In the embodiment shown in FIG. 1, the acoustic signal giving devices and their master clock devices together with their adjusting devices 13, 14 and switches 1*e*, 2*e* are provided in a separate part B of the device which can be detached from the console A containing the stop watch control and the indicating device, said part B being operatable independently of the console A. For this reason, there is arranged in the part B of the device a storage battery and outside of part B of the device there is arranged an operating member 8 for switching to storage battery operation. The part B of the device is attached to the console A, the plug connection containing the electric plug connection for connecting the circuit components of the console A and for loading the storage battery via the mains supplied console A. When part B is detached from the console A, the console A can be operated as a stop watch without simultaneous resoundings of acoustic pulses of the acoustic signal giving device. However, for this purpose there can be provided a special switch for the wanted switching off of the acoustic signal giving device.

Figure 2:
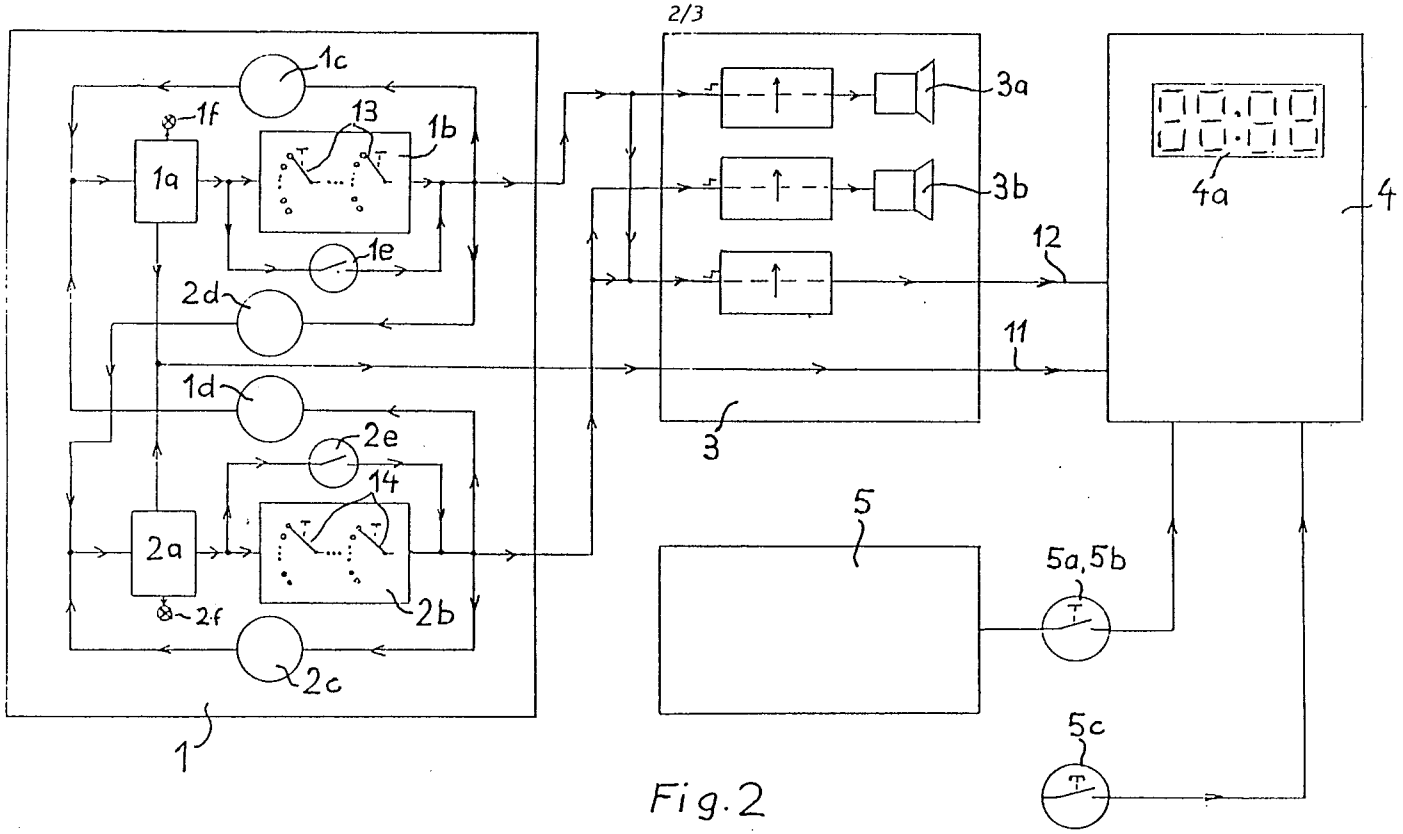
FIG. 2 is a circuit diagram with a functional scheme for the signal apparatus of FIG. 1

According to FIG. 2, the master clock device 1 for the operation of the signal giving device 3 with the first signaler 3*a* and the second signaler 3*b* contains a first time tapper stage 1a and a counting stage 1b controlled by said time tapper stage 1a, the first signaler 3a being controllable by said first counting stage 1b, and further contains a second time tapper stage 2a having a second counting stage 2b linked to it for controlling the second signaler 3b. The counting stages 1b and 2b are settable to the respective clock interval by a way of the adjusting devices 13 rsp. 14. During the run of a clock interval, only one associated time tapper stage 1a rsp. 2a is active, which does switch off via an associated stopping stage 1c rsp. 2c because of an output signal appearing at their output after the expiration of the respective clock interval set at the associated counting stage 1b rsp. 2b, said time tapper stage 1a rsp. 2a simultaneously activating the other time tapper stage 1a rsp. 2a via an associated starting stage 1d rsp. 2d. Apart from that, the associated signaler 3a rsp. 3b is activated to give a short acoustic pulse upon the output signal of the respective counting stage 1b rsp. 2b. In a bypass line of the counting stages 1b rsp. 2b, the associated switch 1e rsp. 2e is switched on, upon the activation of which the respective output signal of the counting stages 1b rsp. 2b can be produced independently of the clock interval set at respective counting stage.

The time of the respective running time tapper stage is given via a common time lead 11 to an indicating device 4 for its forward stepping. The output signal of the respective counting stages 1b rsp. 2b is simultanously put on the set back lead 12 of the indicating device 4 for the purpose of setting back display 4a at the time of expiration of each clock interval. In the survey circuit diagramm according to FIG. 2, also the stop watch master clock 5 is marked, of which the display device 4 is operated as stop watch upon actuation of the stop watch starting/stopping switch 5a, 5b, whereby the display 4 is set back to zero by use of the separate set back switch 5c.

The light-signal devices 1f rsp. 2f, connected to the time tapper stages 1a and 2a, indicate, which of the time tapper stages 1a rsp. 2a presently is in operation.

Figure 3:
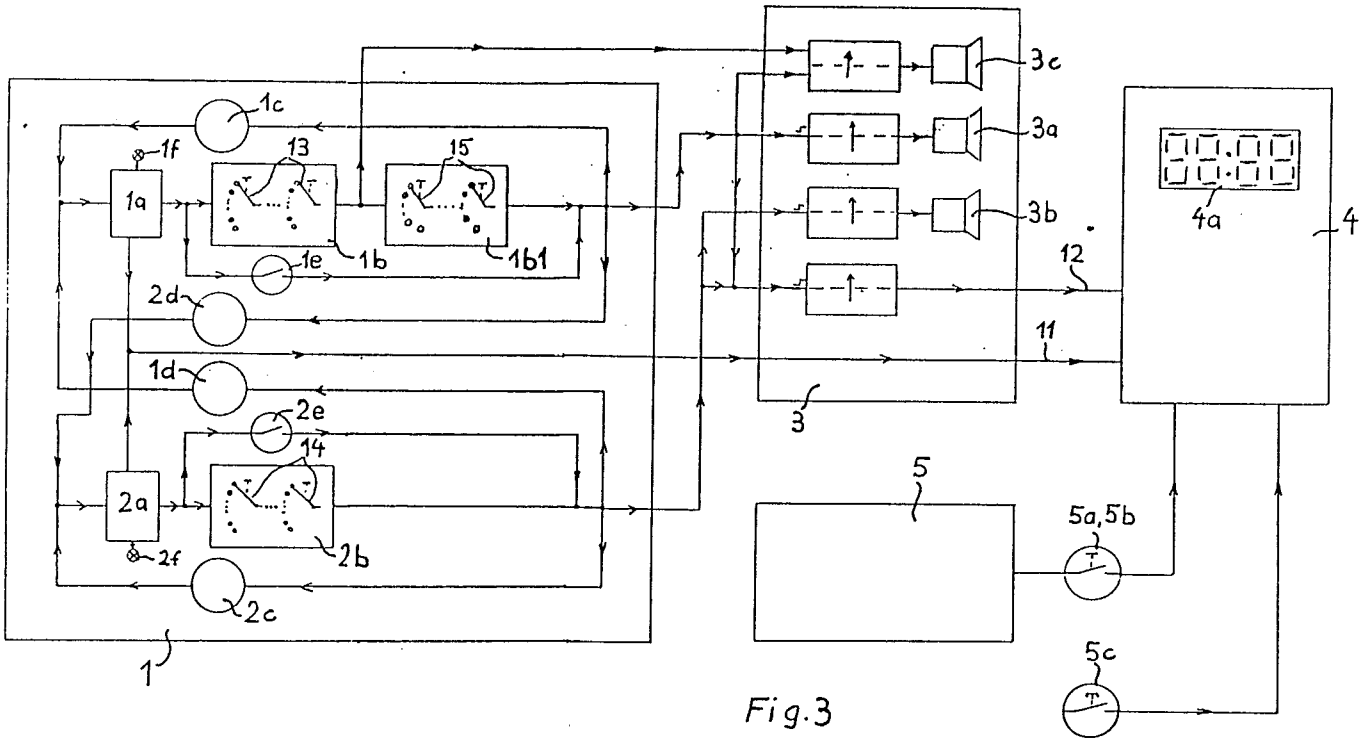
FIG. 3 is a circuit diagram with the functional scheme for a signal apparatus, which, in contrast to the one depicted in FIG. 2, is supplemented by an additional signal producer.

The development of a signal apparatus according to the invention depicted in the survey circuit diagram of FIG. 3 corresponds in its basic structure to the development depicted in FIG. 2, which is indicated in that they have the same reference numbers. However, according to FIG. 3, an additional counting stage 1b1 is connected behind the first counting stage 1b and the signal giving device 3 is endowed with an additional third acoustic signaler 3c.

By use of a separate setter 15 it is possible to set the duration of a residual interval of the first clock interval by the additional counting stage 1b1, so that during this residual interval a continuous or pulsating acoustic signal, which can increase or decrease in volume, is given by the third signaler 3c. At the end of a running period, this additional acoustic signal indicates to the sportsman which is performing the running exercise, that from now on he will have to sprint.

The additional signaler 3c is activated upon appearance of an output signal from the first counting stage 1b, said output signal simultaneously activating the additional counting stage 1b1. After expiration of the residual interval, the first time tapper stage 1a is switched off via the stopping stage 1c upon appearance of output signals from the additional counting stage 1b1, the second time tapper 2a is switched on via the starting stage 2d, the signaler 3a is activated and the display 4a of the indicating device 4 is set back, just as with the embodiment depicted in FIG. 2. Additionally to that, the additional signaler 3c is turned off upon appearance of the output signal from the additional counting stage 1b1. In the case that the additional counting stage 1b1 is set to zero, the additional acoustic pulse is suppressed and the apparatus operates as the one depicted in FIG. 2.

With the embodiment depicted in FIG. 3, the time interval until the beginning of the following residual interval is set by the first counting stage 1b, the duration of the residual time interval being set by the additional counting stage 1b1. However, it is possible to develop the circuit of the signal apparatus with the help of means known to a persons skilled in the art in such a way, that the total time interval up to the expiration of also the residual time interval can be set by the counting stage 1b, the residual time interval being settable by an additional counting stage. In this case, the two counting stages are coupled in such a way that the set residual time interval is always, with unchanged duration, the last time interval of the changed total time interval with every changing of the total time interval. Further, it can be achieved with the help of known means, that the light-signal device 1f does not shine continuously during the residual time interval, but does flash to indicate also optically the sprinting period.

The constructional details of circuit organization for the realisation of the explained functions of the signal apparatus according to the invention are known to a persons skilled in the art, so that these constructional details need not be described in particular.

What is claimed:

1. An athletic timer device comprising:

first, second and third sound generation means, each for generating a respective acoustic signal in response to first, second and third respective control signals;

a first counter means for counting a first interval, for manually selecting the duration of said first interval, and for outputting said first control signal to said first sound generation means when said first interval has been counted;

a second counter means connected to receive said first control signal for counting a second interval upon occurrence of said first control signal, for manually selecting the duration of said second interval, and ford outputting said second control signal to said second sound generation means when said first interval has been counted; and a third counter means responsive to occurrence of said second control signal for counting a third interval, for manually selecting the duration of said third interval, and for supplying said third control signal to said third sound generation means when said third interval has been counted.

2. The athletic timer device of claim 1 wherein said first, second and third sound generation means and said first, second and third counter means are contained in a first housing, and further including a second housing having a display means for visually displaying the counting of said first, second and third time intervals, and wherein said first housing detachably fits together with said second housing to form a timer unit, said first housing further including power source means for energizing said first, second and third sound generation means and said first, second and third counter means, such that said first housing is operational when detached.

3. The timer device of claim 2 wherein said second housing includes means for operating said display as a stop watch when said first housing is detached therefrom.

* * * * *